US005634770A

United States Patent [19]

Gilbert et al.

[11] Patent Number: 5,634,770

[45] Date of Patent: *Jun. 3, 1997

[54] MOLTEN METAL PUMP WITH VANED IMPELLER

[75] Inventors: Ronald E. Gilbert, Chardon; David M. Masarin, Hinckley; George S. Mordue, Ravenna, all of Ohio

[73] Assignee: Metaullics Systems Co., L.P., Solon, Ohio

[ * ] Notice: The term of this patent shall not extend beyond the expiration date of Pat. No. 5,092,821.

[21] Appl. No.: 460,979

[22] Filed: Jun. 5, 1995

Related U.S. Application Data

[63] Continuation-in-part of Ser. No. 312,327, Sep. 26, 1994, Pat. No. 5,470,201, which is a continuation-in-part of Ser. No. 898,043, Jun. 12, 1992, abandoned.

[51] Int. Cl.[6] ..... F04D 29/20

[52] U.S. Cl. ..... 415/216.1; 464/179; 464/181

[58] Field of Search ..... 415/216.1; 464/179, 464/181

[56] References Cited

U.S. PATENT DOCUMENTS

| | | | |
|---|---|---|---|
| 1,912,412 | 6/1933 | Stubbs | 464/179 |
| 2,017,302 | 10/1935 | Yoder . | |
| 2,054,923 | 9/1936 | Betterton et al. . | |
| 2,072,650 | 3/1937 | Schmeller, Sr. . | |
| 2,528,210 | 10/1950 | Stewart . | |
| 2,598,780 | 6/1952 | Garnier . | |
| 2,858,768 | 11/1958 | Gaylord et al. . | |
| 2,973,214 | 2/1961 | Bates et al. | 403/290 |
| 3,115,096 | 12/1963 | Wall . | |
| 3,227,547 | 1/1966 | Szekely . | |
| 3,324,798 | 6/1967 | Freed et al. . | |
| 3,573,895 | 4/1971 | Östberg . | |
| 3,650,513 | 3/1972 | Werner . | |
| 3,690,621 | 9/1972 | Tanaka et al. . | |
| 3,767,382 | 10/1973 | Bruno et al. . | |
| 3,776,660 | 12/1973 | Anderson et al. . | |
| 3,791,813 | 2/1974 | Ramachandran et al. . | |
| 3,792,848 | 2/1974 | Östberg . | |
| 3,814,396 | 6/1974 | DiGregorio et al. . | |
| 3,839,019 | 10/1974 | Bruno et al. . | |
| 3,861,660 | 1/1975 | Ammann et al. . | |
| 3,871,872 | 3/1975 | Downing et al. . | |
| 3,887,172 | 6/1975 | Funck et al. . | |
| 3,953,552 | 4/1976 | Strauss . | |
| 3,984,234 | 10/1976 | Claxton . | |
| 4,188,287 | 2/1980 | Faulkner et al. . | |
| 4,283,357 | 8/1981 | Sidery . | |
| 4,287,137 | 9/1981 | Sonoyama et al. . | |
| 4,297,214 | 10/1981 | Guarnaschell . | |
| 4,351,514 | 9/1982 | Koch . | |
| 4,425,232 | 1/1984 | Lawrence et al. . | |
| 4,426,068 | 1/1984 | Gimond et al. . | |
| 4,454,078 | 6/1984 | Engelbrecht et al. . | |
| 4,470,846 | 9/1984 | Dubé . | |
| 4,491,474 | 1/1985 | Ormsher . | |
| 4,518,424 | 5/1985 | Ormesher . | |
| 4,592,658 | 6/1986 | Claxton . | |
| 4,595,383 | 6/1986 | Nienhaus . | |

(List continued on next page.)

FOREIGN PATENT DOCUMENTS

| | | | |
|---|---|---|---|
| 1024602 | 1/1953 | France . | |
| 1382504 | 11/1964 | France . | |
| 2376310 | 12/1977 | France . | |
| 211589 | 7/1909 | Germany | 464/179 |
| 12680 | of 1906 | United Kingdom | 464/179 |
| 504982 | 5/1939 | United Kingdom | 464/179 |

*Primary Examiner*—Thomas E. Denion
*Assistant Examiner*—Christopher Verdier
*Attorney, Agent, or Firm*—Fay, Sharpe, Beall, Fagan, Minnich & McKee

[57] ABSTRACT

An elongated shaft suited to a molten metal environment which forms a connection between a rotor and an impeller. The shaft being formed with at least one end, in cross-section, having a plurality of rounded side portions with a relatively large radius and rounded corners having a relatively small radius connecting the side portions.

10 Claims, 13 Drawing Sheets

U.S. PATENT DOCUMENTS 4,607,959 8/1986 Miyazaki et al. .
4,664,592 5/1987 Grzina .
4,673,434 6/1987 Withers et al. .
4,786,230 11/1988 Thut .
4,940,384 7/1990 Amra et al. .
5,025,198 6/1991 Mordue et al. ..... 318/434
5,028,211 7/1991 Mordue et al. .
5,088,893 2/1992 Gilbert et al. .
5,092,821 3/1992 Gilbert et al. ..... 464/152 X
5,165,858 11/1992 Gilbert et al. .
5,192,193 3/1993 Cooper et al. .
5,330,328 7/1994 Cooper .

MOLTEN METAL PUMP WITH VANED IMPELLER

This application is a continuation-in-part of U.S. Ser. No. 312,327 filed on Sep. 26, 1994, now U.S. Pat. No. 5,470,201, which is a continuation-in-part of U.S. Ser. No. 898,043 which was filed on Jun. 12, 1992, now abandoned.

FIELD OF THE INVENTION

This invention relates to molten metal pumps, and more particularly, to pumps utilizing a vaned impeller.

BACKGROUND OF THE INVENTION

In the processing of molten metals, it is often necessary to pump molten metal from one place to another. When it is desired to remove molten metal from a vessel, a so-called transfer pump is used. When it is desired to circulate molten metal within a vessel, a so-called circulation pump is used. When it is desired to purify molten metal disposed within a vessel, a so-called gas injection pump is used. In each of these pumps, a rotatable impeller is disposed, preferably within a volute case, accessible to the molten metal in the vessel. Upon rotation of the impeller within the volute, the molten metal is pumped as desired in a direction permitted by the volute.

In each of the pumps referred to, the impeller is disposed within the volute formed in a base member. Typically, the base member is suspended within the molten metal by means of posts. The impeller is supported for rotation in the base member by means of a rotatable shaft connected to the drive motor with a coupling. The base member includes an outlet passage in fluid communication with the impeller, and upon rotation of the impeller, molten metal is drawn into the volute and an open section of the impeller, where it then is discharged under pressure to the outlet passage.

Molten metal pump designers are generally concerned with efficiency and effectiveness. For a given diameter impeller, pump efficiency is defined by the work output of the pump divided by the work input of the motor. The equally important quality of effectiveness is defined as molten metal flow per impeller revolutions per minute.

Although pumps previously known in the art operate satisfactorily to pump molten metal from one place to another, certain problems have not been completely addressed. Particularly, these problems relate to the effectiveness of the impeller, duration of operability and consistency of performance.

U.S. Pat. No. 4,940,384, herein incorporated by reference, shows a molten metal pump with a cup-like impeller body having vanes and lateral openings for moving molten metal. Although the impeller of this pump transports molten metal, it is prone to clogging by foreign materials such as semi-solids and solids, e.g. drosses, refractory debris, metallic inclusions, etc., (hereinafter referred to as "particles") contained in the vessel and frequently drawn into the molten metal pump. If a large particle is drawn into the pump, the impeller can be jammed against the volute case, causing catastrophic failure of the pump. Even if catastrophic failure does not occur, small particles eventually clog the lateral openings and degrade the performance of the impeller by reducing the volume of molten metal it can transfer. Accordingly, it is desirable in the art to have an impeller which minimizes clogging, thereby maintaining high efficiency over time and avoiding catastrophic failure.

U.S. Pat. Nos. 3,776,660 and 5,192,193 also teach molten metal impellers, however these designs have more extensive vanes than U.S. Pat. No. 4,940,384. Nonetheless, each of U.S. Pat. Nos. 3,776,660 and 5,192,193 continue to suggest an impeller design having a larger inlet area than outlet area. Accordingly, the problem of clogging is not overcome by these designs. Moreover, it is easy to envision a particle of debris having a size which enters the inlet, adjacent the impeller center, but too large to pass through the narrower passages between the vanes. This particle then bounces around the impeller inlet, reducing flow and degrading the vanes.

Impeller-type equipment without lateral openings has been utilized in molten metal stirring and/or submersion types of devices. U.S. Pat. No. 4,898,367 shows a gas dispersion rectangular block without openings. However, this stirring device does not achieve a directed, forced fluid flow. Particularly, the impeller must be rotatable within a housing to maximize forced flow from the impellers rotation. In addition to block type molten metal agitation devices, vaned circular equipment has been used, see U.S. Pat. No. 3,676,382. Again, however, there is no means for achieving forced directional molten metal flow. Such forced directional molten metal flow is highly necessary in the application of pumping technology to molten metal processing. For example, in a circulation mode, better convectional heat transfer occurs (greater kinetic energy imparted by the pump), and faster melting exists as solid charge materials such as scrap or ingot is mixed more quickly and thoroughly into and with the liquid metal. In a transfer mode, the liquid metal is more strongly directed or redirected into a conveying conduit such as a riser or pipeline for more efficient transfer at a higher rate as a result of such improved forced directional molten metal flow. In a gas injection mode, treatment with gas is more readily achieved with a contained molten metal flux.

In summary, the molten metal treatment art described in the above paragraphs fails to achieve important advantages of the current invention. Particularly, either there is not effective prevention of clogging and/or there is no means to achieve directional forced molten metal flow.

The current invention achieves a number of advantages in directional forced molten metal flow. For example, the impeller of the current pump is not prone to clogging of lateral openings as in the prior pump impellers. Accordingly, catastrophic failure is much less likely to occur and the effectiveness of the impeller operation does not degrade as rapidly over time. The design also achieves high strength by increasing the load area material thickness. Furthermore, the impeller design can be prepared with easy manufacturing processes. Accordingly, the cost of production is reduced and accommodates a wide selection of impeller material, such as graphite or ceramic. Also, the current impeller invention is adaptable to allow optimization as required without large scale manufacturing alteration.

SUMMARY OF THE INVENTION

Accordingly, it is the primary object of this invention to provide a new and improved molten metal pump.

It is a further objective of this invention to provide a new and improved impeller for use in a molten metal pump.

To achieve the foregoing objects and in accordance with the purpose of the invention as embodied and broadly described herein, the molten metal pump of this invention comprises an elongated drive shaft having first and second ends, the first end extending out of a molten metal bath and the second end extending into the molten metal bath. An impeller is attached to the second end of the drive shaft. The impeller has a solid base portion with at least one face and at least two vanes extending substantially perpendicular from the face. The vanes extend radially from the center of the face and are positioned to create a smaller impeller inlet area than impeller outlet area. The first end of the elongated shaft adapted to be connected to a coupling which in turn is adapted to be connected to a drive motor, the end being non-cylindrical in cross-section and including a plurality of rounded side portions having a relatively large radius and rounded corners connecting the side portions, the corners having a relatively small radius.

The impeller is disposed within a pumping chamber having an inlet into which molten metal can be drawn and an outlet through which molten metal can be forcibly discharged by the impeller's rotation. Preferably, the pumping chamber is a volute.

Volute, as used herein, means a casing which facilitates the impeller's convergence and expulsion of molten metal. Solid, as used herein, means a lack of openings capable of accommodating molten metal flow. More particularly, sold means imperforate. Face, as used herein, means a relatively flat surface.

DETAILED DESCRIPTION OF THE INVENTION

While the invention will be described in connection with a preferred embodiment, it will be understood that it is not intended to limit the invention to that embodiment. On the contrary, it is intended to cover all alternatives, modifications, and equivalents as may be included within the spirit and scope of the invention defined by the appended claims.

Figure 1:
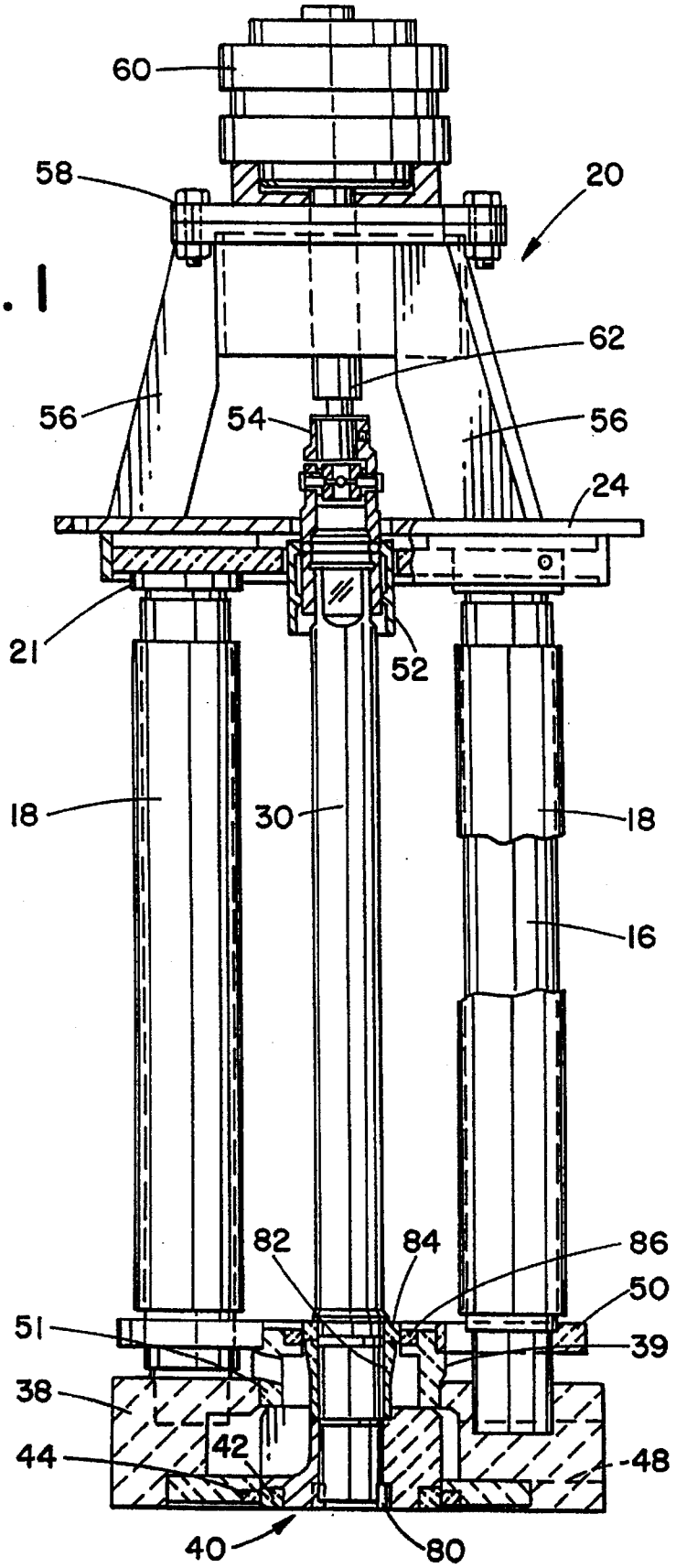
FIG. 1 is a cross-sectional view of a molten metal pump.
Figure 2:
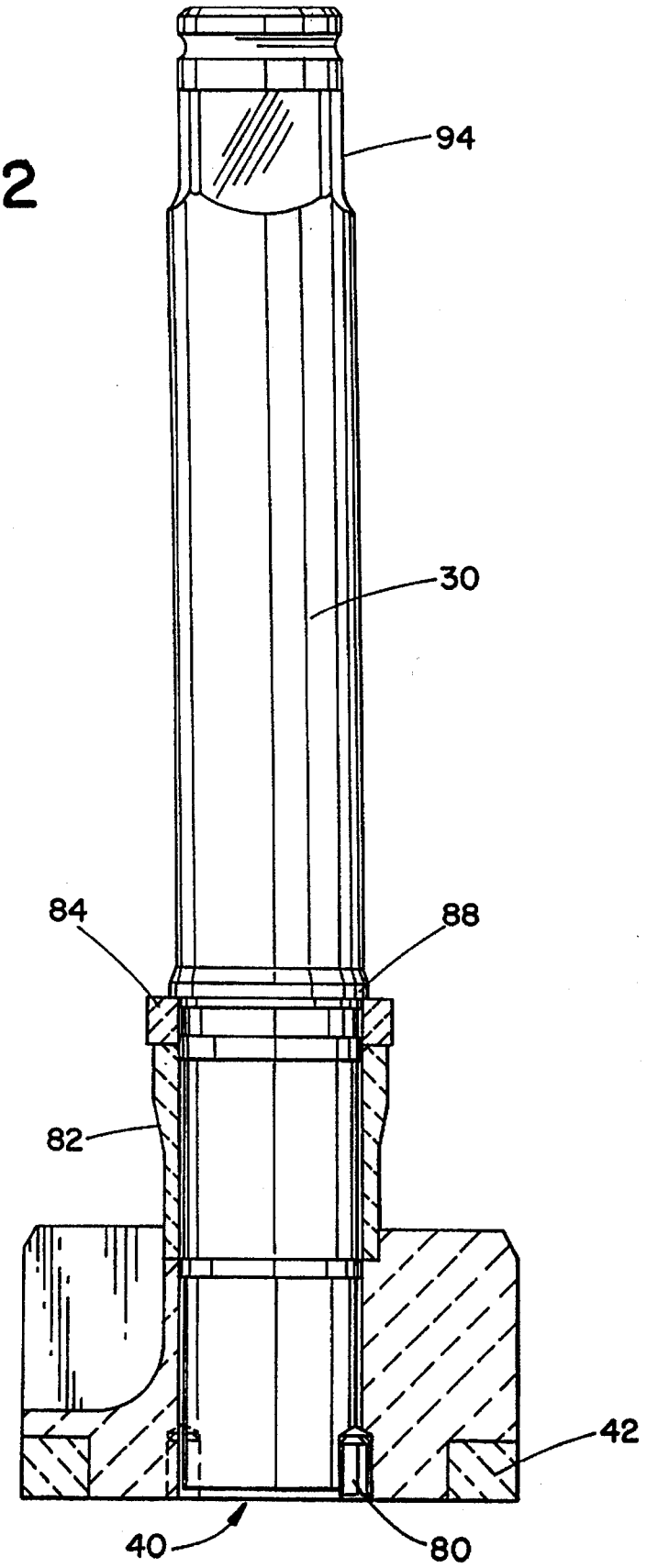
FIG. 2 is a cross-sectional view of an impeller attached to a drive shaft for use in a molten metal pump.

Referring now to FIGS. 1 and 2, a molten metal pump according to the invention is indicated generally by the reference numeral 20. The pump 20 is adapted to be immersed in molten metal contained within a vessel (not shown). The vessel can be any container holding molten metal.

It is to be understood that the pump can be any type of pump suitable for pumping molten metal. Generally, however, the pump 20 will have a base member 38 within which an impeller 40 is disposed. The impeller 40 is supported for rotation within the base member 38 by means of an elongated, rotatable shaft 30. The upper end of the shaft 30 is connected with shaft 62 to a motor 60. The motor 60 can be of any desired type, for example air or electric. The pump 20 is supported by means of posts 16, including protective post sleeves 18, and a support plate 24 attached via post sockets 21. The motor is positioned above the support plate 24 with struts 56 and a motor support platform 58. The drive shaft 30 and posts 16 are typically made of graphite, with a refractory coating of boron nitride. A particularly preferred graphite is Metaullics Systems Co., L.P., 31935 Aurora Road, Solon, Ohio 44139, ZX grade graphite.

The base member 38 includes an outlet passageway 48. A riser, to form a transfer pump, could be connected to the base member 38 in fluid communication with the passageway 48. Alternatively, a gas injection pump could be assembled by including a gas injection apparatus with outlet passageway 48. The pump 20 is best described as a so-called circulation pump, that is, it circulates molten metal within the vessel.

As indicated earlier, however, the pump 20 is described for illustrative purposes and it is understood that the pump 20 can be of any type suitable for pumping the molten metal. Although the pump 20 is shown as a top feed, a particular advantage of the present impeller is its functionality in a bottom feed pump. Particularly, bottom feed pumps generally ingest a greater quantity and size of particles which make impeller clogging a significant problem. This inventive impeller reduces such problems to an extent which makes bottom feed pumps practical. As will be understood by those skilled in the art, a variety of pump designs. are suitable for use with the inventive impeller. For example, a bottom feed pump may be especially long lived because prior art impellers which clog with dross and debris are not suitable to the harsher treatment of bottom feed whereas the subject impeller is not readily effected by the "dirty" aluminum more often encountered in a bottom feed pump.

Notwithstanding this improved performance, the base member 40 may include a baffle plate 50 and a shaft mount bearing 51 to reduce exposure of the impeller to debris.

The impeller 40 is secured via cement, such as FRAXSET, obtainable from Metaullics Systems Co., L.P. A first bearing ring 42 of silicon carbide or other material having bearing properties at high temperature is disposed about the lower most end of the impeller 40. A second bearing ring 44 of silicon carbide or other material having bearing properties at high temperature is disposed at the lower most end of the base member in facing relationship to the first bearing ring 42.

As will be apparent from the foregoing description, the impeller 40 is rotatable relative to the base member 38. The bearing rings 42 and 44 will prevent friction related wear of the base member 38 and the impeller 40 from occurring. This base member 38 includes volute case 39 within which the impeller 40 is disposed.

The upper, or first end 94 of the drive shaft 30 is connected to the motor 60 via coupling assembly 52, including torque limiting device 54 as shown in U.S. Pat. No. 5,092,821. Preferably, the drive shaft is of a quadrilobal nature, as described in U.S. Pat. No. 5,092,821, herein incorporated by reference.

Particularly, the impeller shaft according to the invention is an elongate, cylindrical member that at one end is adapted to receive an impeller or other element, such as a rotor, and is adapted at its other end to be connected to a drive motor. The shaft requires minimal machining, and it completely avoids the use of threads. The impeller-shaft connection is made by providing an opening through the center of the impeller and placing the shaft in the opening. The impeller is cemented to the end of the shaft to prevent axial separation. Relative rotational movement is prevented by forming the impeller opening and the end of the shaft in a modified "square drive" configuration that includes convex side portions connected by rounded corners. At its other end, the shaft is configured the same as the impeller end.

The drive system according to the invention includes a coupling having first and second housings and defining a longitudinal axis of rotation. The first housing is adapted to be connected directly to a drive motor and the second housing is adapted to be connected to the non-impeller end of the impeller shaft. The second housing includes a modified "square drive" opening into which the shaft can be fitted. The non-impeller end of the impeller shaft is provided with a threaded stud that projects from the end of the shaft. A threaded nut is disposed within the second housing for engagement with the stud. The nut is rotatable relative to the stud and the second housing, thereby permitting the axial position of the shaft to be adjusted easily.

The invention also includes a quick disconnect feature for the shaft. In the preferred embodiment, the adjustment nut is provided with radially extending openings into which drive pins carried by an annular sleeve will fit. The pins normally are biased into the openings by means of an axially movable knob. However, upon displacing the knob against a spring bias, the pins will be removed from the openings in the nut, thereby permitting the nut (as well as the stud and the impeller shaft) to be removed from the second housing.

The invention also includes a universal joint for reducing vibrational loads that otherwise would be applied to the shaft. The universal joint is included as part of the first housing. The universal joint in the preferred embodiment includes an input collar rigidly secured to the drive shaft of the drive motor. The input collar is concentrically disposed within the housing. Rotatable keys project outwardly from the collar and engage shoes carried by the housing. The keys and shoes include respective convex/concave surfaces that enable the housing and the shaft to be pivoted relative to each other. The lower portion of the first housing is fluid-tight so that lubricating fluid such as oil can permanently be retained within the housing, thereby providing continual lubrication for the universal joint.

By use of the present invention, damage to the impeller shaft is eliminated or substantially reduced, in part because the strength of the shaft and the universal joint tend to prevent catastrophic failure of the shaft. The universal joint also is very reliable because it is permanently lubricated. The impeller and the shaft can be connected easily and quickly, and the resultant connection is very strong. The particular construction of the coupling enables the shaft to be connected and disconnected from the drive motor quickly, and to be easily adjusted axially relative to the drive motor. Moreover, the coupling is constructed such that it can be disassembled without special tools or equipment, thereby facilitating the replacement of worn or broken parts.

Figure 10:
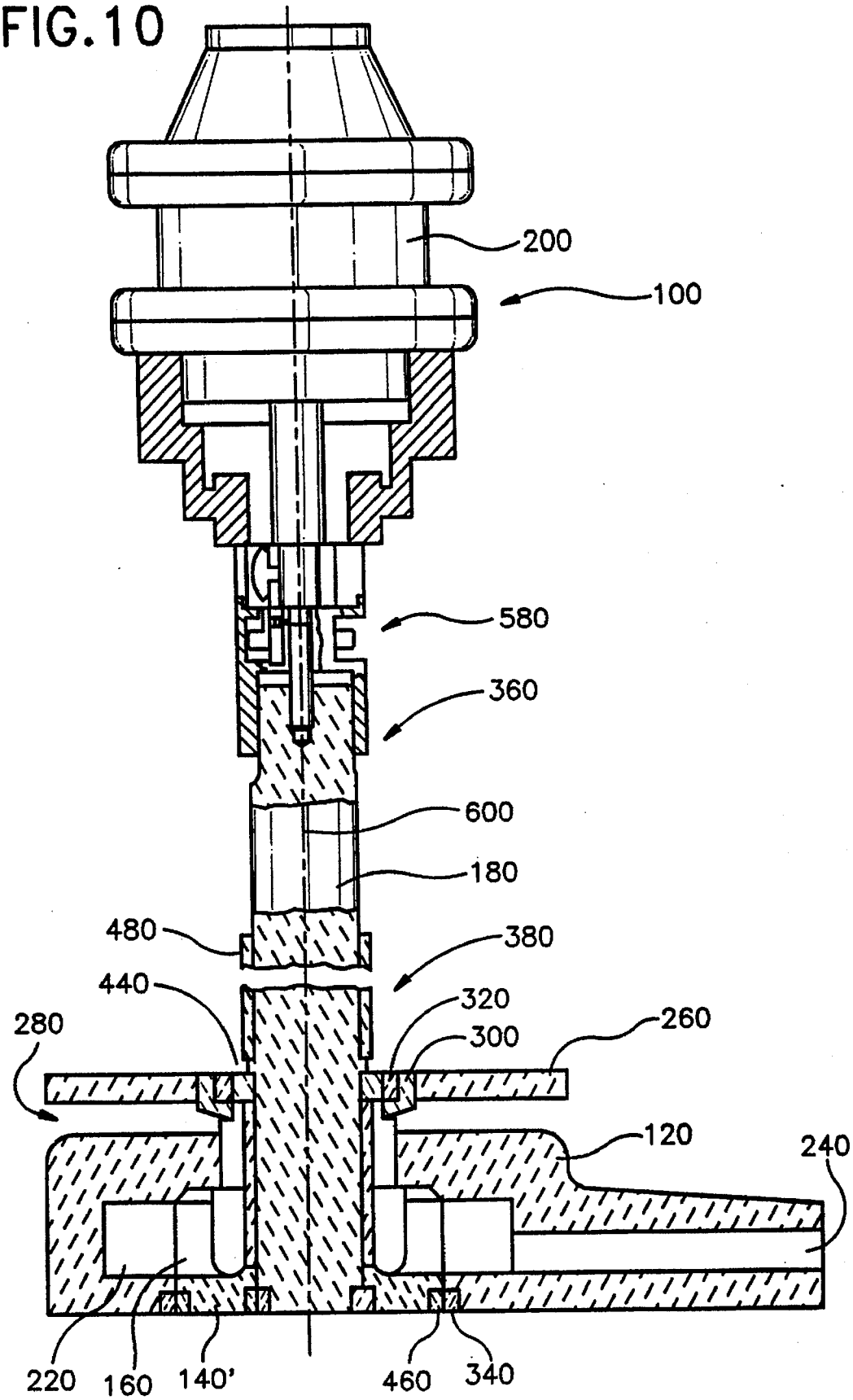
FIG. 10 is a cross-sectional view of a molten metal pump, showing an impeller shaft and a drive system according to the invention.

Referring to FIG. 10, a molten metal pump is indicated generally by the reference numeral 100. The pump 100 is adapted to be immersed in molten metal containing within a vessel (not shown). The vessel can be any container containing molten metal such as the external well of a reverberatory furnace.

It is to. be understood that the pump 100 can be any type of pump suitable for pumping molten metal. Generally, however, and as particularly shown in FIG. 10, the pump 100 will have a base member 120 within which an impeller 140 is disposed. The impeller 140 includes a plurality of radially extending openings 160. The impeller 140 is supported for rotation within the base member 120 by means of an elongate, rotatable shaft 180. The upper end of the shaft 180 is connected to a motor 200. The motor 200 can be of any desired type.

The base member 120 includes a pumping chamber 220 and an outlet passageway 240 in fluid communication with the chamber 220. Because the passageway 240 is disposed beneath the upper surface of the molten metal, the pump 100 functions as a so-called circulation pump, that is, it circulates molten metal within the vessel. As indicated earlier, however, the pump 100 is described for illustrative purposes and it is to be understood that the pump 100 can be any type suitable for the pumping of molten metal.

A baffle plate 260 is connected to the upper portion of the base member 120 and is spaced therefrom a small distance in order to define a fluid inlet 280. The baffle plate 260 is supported by a shaft bearing mount 300. A bearing ring 320 of silicon carbide or other material having bearing properties at high temperature is disposed within the bearing mount 300. In like manner, a second bearing ring 340 of silicon carbide or other material having bearing properties at high temperature is disposed at the lowermost end of the based member 120 in facing relationship to the lowermost end of the impeller 140.

The shaft 180 typically is formed of graphite. It is to be understood that the present invention is especially effective with shafts made of graphite; however, the invention is usable with shafts made of other materials such as ceramic or coated metal. The use of the phrase "graphite shafts" used herein is intended to encompass all such materials, where the use of such materials would be appropriate.

The first, or upper end of the shaft 180 is indicated by the reference numeral 360. The second, or lower end of the shaft 180 is indicated by the reference numeral 380. The first end 360 is adapted to be connected to the drive motor 200, while the second end 380 is adapted to be connected to the impeller 140.

Figure 19:
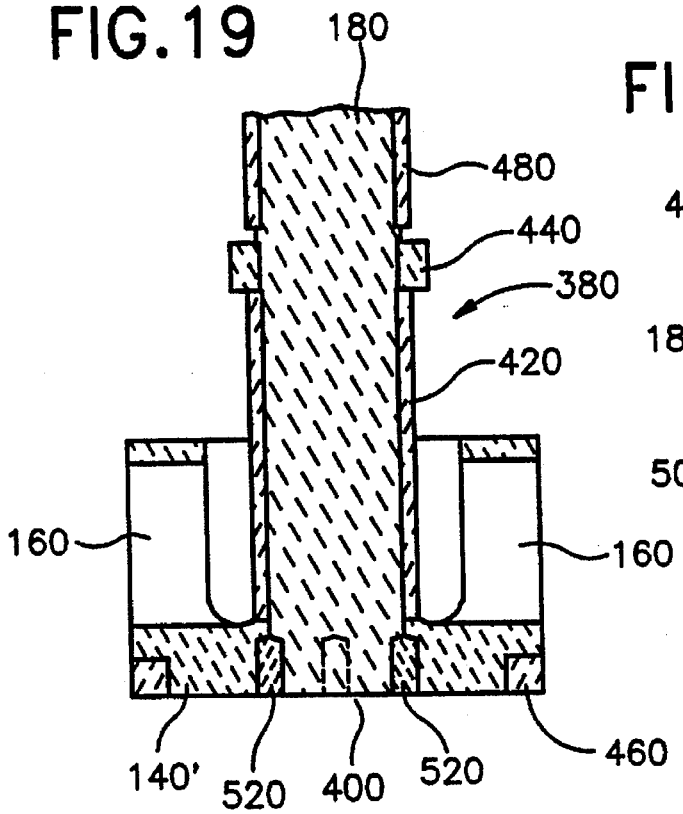
FIG. 19 is a cross-sectional view of an alternative embodiment of the impeller shaft according to the invention.
Figure 20:
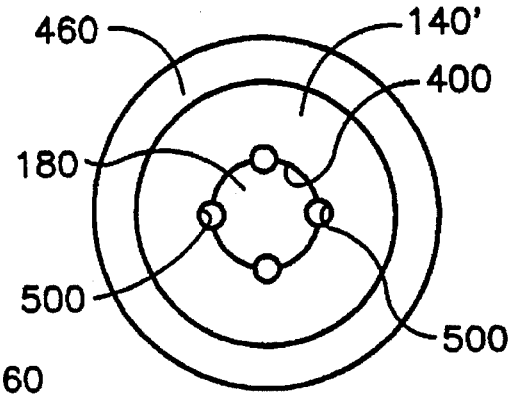
FIG. 20 is a bottom plan view of the impeller shaft of FIG. 19.

Referring particularly to FIGS. 19 and 20 which illustrate an alternative embodiment of the invention, the second end 380 is generally cylindrical, and is received within a cylindrical opening 400 formed in the impeller 140. A cylindrical sleeve 420 is disposed about the lower end 380. The upper end of the sleeve 420 engages a bearing ring 440 which is axially fixed relative to the shaft 180. A bearing ring 460 is disposed about the lower most end of the impeller 140. The bearing rings 440, 460 are made of silicon carbide or other material having bearing properties at high temperature. The bearing rings 440, 460 in use are disposed in facing relationship to the bearings rings 320, 340 respectively.

A second sleeve 480 is disposed about the shaft 180 at a vertical location above the ring 440. As is indicated in FIG. 19, the sleeve 420 not only serves to space the impeller 140 at a proper axial location relative to the shaft 180, but it also serves to maintain the axial location of the bearing ring 440 relative to the base member 120. The sleeve 420 provides mechanical support for the bearing ring 440. In use, the bearing ring 440 is subjected to various stresses. The sleeve 420 helps to reduce premature failures of the bearing ring 440.

The impeller 140', the sleeves 420, 480, and the bearing ring 460 are secured to the second end 380 by means of refractory cement such as FRAXSET, commercially available from the Metaullics Systems Division of The Carborundum Company, 31935 Aurora Road, Solon, Ohio 44139. The refractory cement prevents relative axial movement between the impeller 140' and the shaft 180. In order to prevent relative rotational movement between the impeller 140' and the shaft 180, a plurality of openings 500 are formed in the impeller 140' and the shaft 180 at the interface between the two. The openings 500 are aligned with the longitudinal axis of the shaft 180. Dowels 520 (FIG. 19) are inserted into the openings 500 and retained there by means of refractory cement. The dowels 520 thus function as keys.

As illustrated, the shaft 180 is cylindrical and the second end 380 is received within a cylindrical opening 400 by means of a non-threaded connection. It will be appreciated that the second end 380 could take other configurations such as splined, "square drive", and other non-cylindrical forms. While a cylindrical configuration offers various advantages such as the ready availability of cylindrical shafts and the simplicity and strength of the previously described shaft-impeller connection, a preferred shaft-impeller connection has been discovered.

Figure 21:
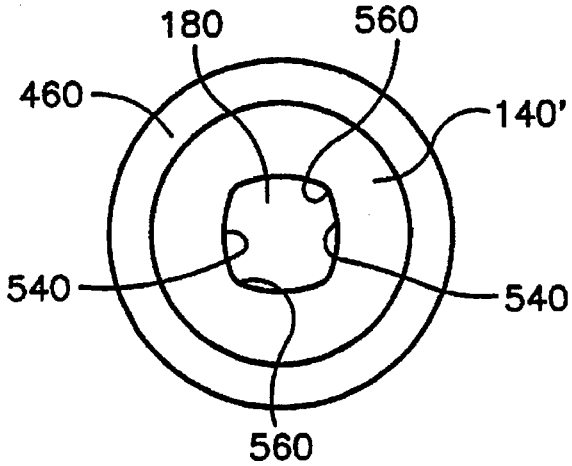
FIG. 21 is a bottom plan view of a preferred impeller shaft according to the invention; and, FIG. 22 is an alternative coupling between the motor and rotatable shaft.

Referring particularly to FIG. 21, the opening in the impeller 140' can be formed in a modified "square drive" configuration. In particular, the opening can include concave sidewall portions 540 having a relatively large radius, and rounded corners 560 having a relatively small radius. As illustrated in FIG. 21, four sidewall portions 540 are provided, with four corners 560 connecting the adjacent sidewall portions 540. The second end 380 is provided with matching sidewall portions and corners, wherein adjacent sidewall portions are generally at right angles, so as to snugly fit within the opening defined by the sidewall portions 540 and the corners 560 of the impeller 140'. For a shaft 180 having a nominal outer diameter of about 4.0 inches, the second end 380 will be reduced in size to provide a maximum sidewall-to-sidewall spacing of about 3.192 inches, and a maximum corner-to-corner spacing on the diagonal of about 3.622 inches. The radius of the sidewall portions 540 will be about 2.972 inches, while the radius of the corners 560 will be about 0.375 inches.

As with the embodiment described in FIGS. 19 and 20, the modified square drive connection between the impeller 140' and the shaft 180 can be secured by means of refractory cement. Although the embodiment of the invention illustrated in FIG. 21 is slightly more difficult to machine than the embodiment illustrated in FIGS. 19 and 20, it is believed to be stronger, due in part to the rounded sidewall portions and the rounded corners.

Figure 11:
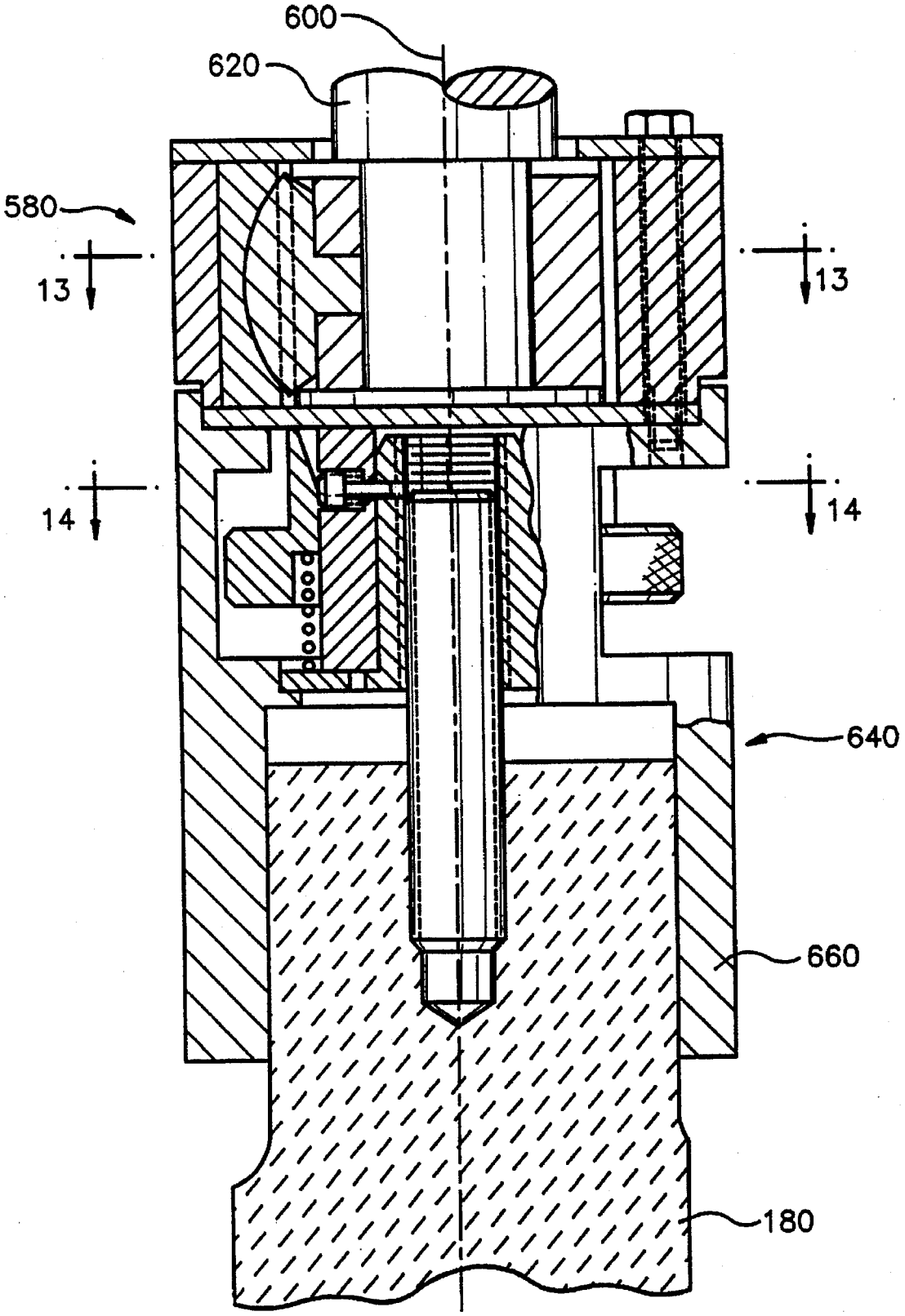
FIG. 11 is an enlarged cross-sectional view of a portion of the impeller shaft and a coupling according to the invention.
Figure 12:
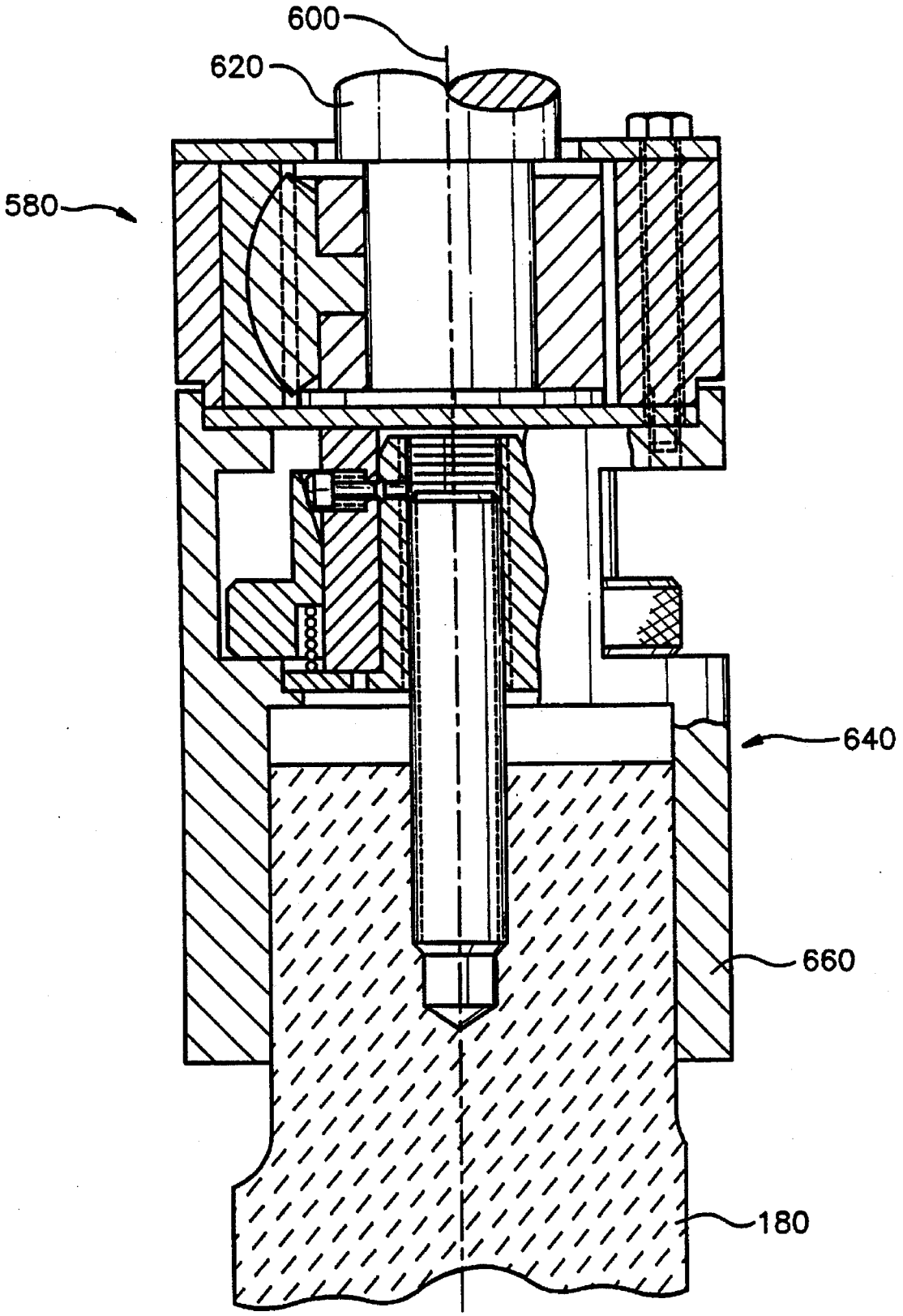
FIG. 12 is a view similar to FIG. 11, showing portions of the coupling moved to a shaft-disconnect position.
Figure 13:
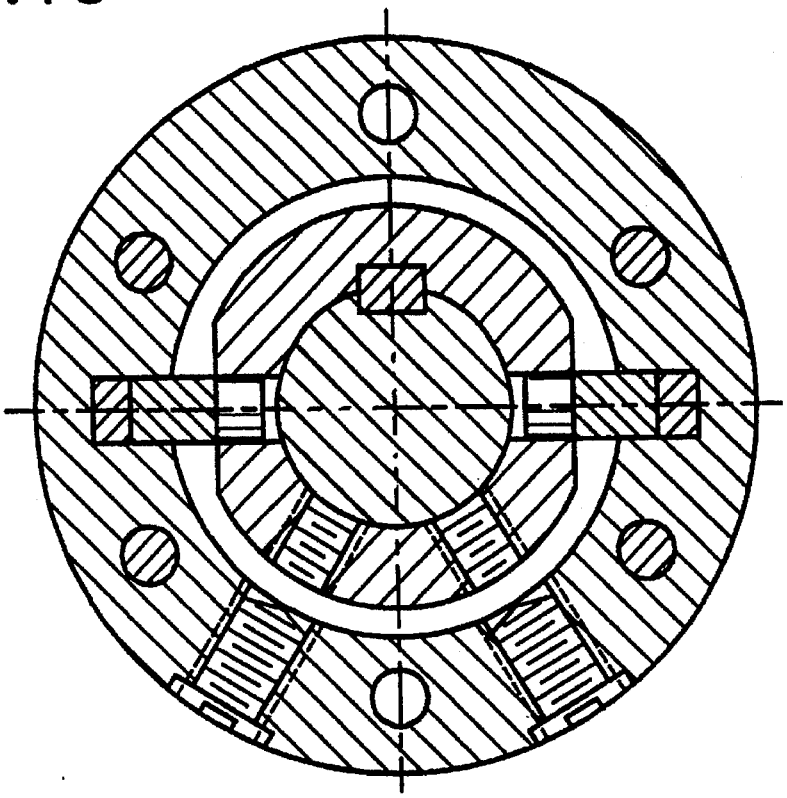
FIG. 13 is a cross-sectional view of a universal joint portion of the coupling taken along a plane indicated by line 4—4 in FIG. 11.
Figure 14:
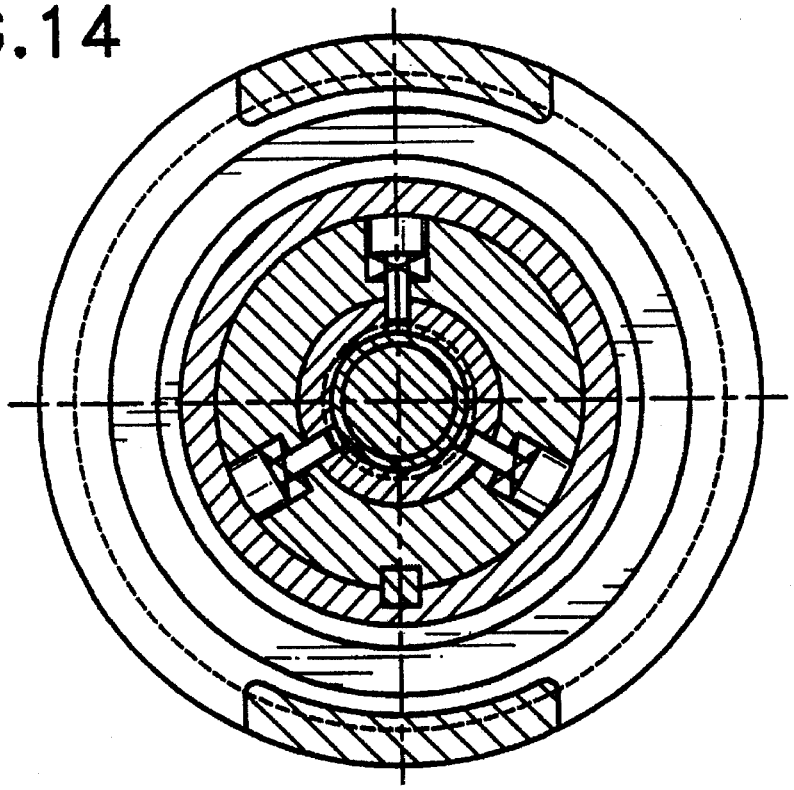
FIG. 14 is a cross-sectional view of a disconnect and axial adjustment portion of the coupling according to the invention taken along a plane indicated by line 5—5 in FIG. 11.
Figure 17:
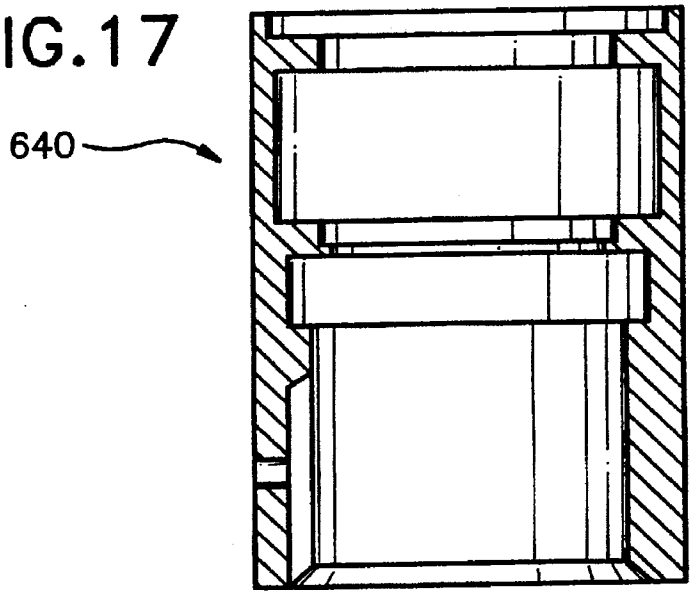
FIG. 17 is a cross-sectional view of an alternate housing usable as part of the present invention, with internal components removed for clarity of illustration.
Figure 18:
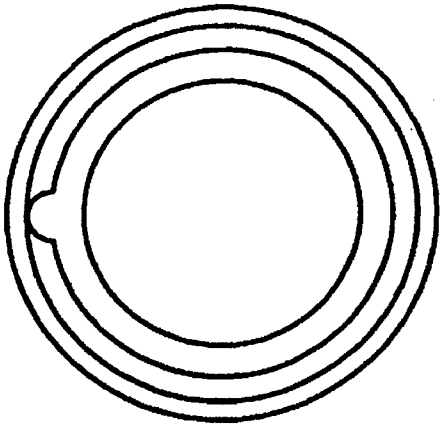
FIG. 18 is a bottom plan view of the housing of FIG. 17.

Referring particularly to FIGS. 10–12, the first end 360 is connected to a coupling 580 that defines a longitudinal axis of rotation 600. The coupling 580 is connected to a drive shaft 620 extending from the motor 200, which drive shaft 620 is rotatable about a longitudinal axis coincident with the axis 600.

Figure 15:
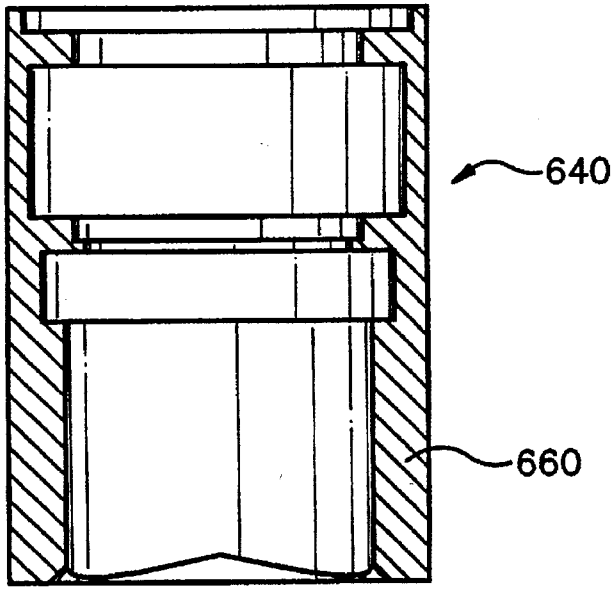
FIG. 15 is a cross-sectional view of an output housing usable with the present invention, with internal components removed for clarity of illustration.
Figure 16:
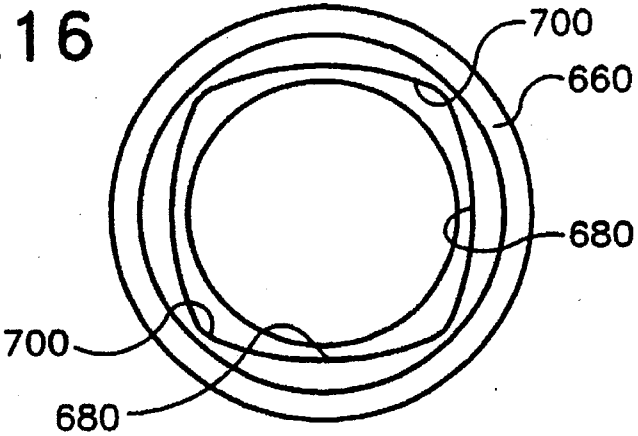
FIG. 16 is a bottom plan view of the housing of FIG. 15.
Figure 22:
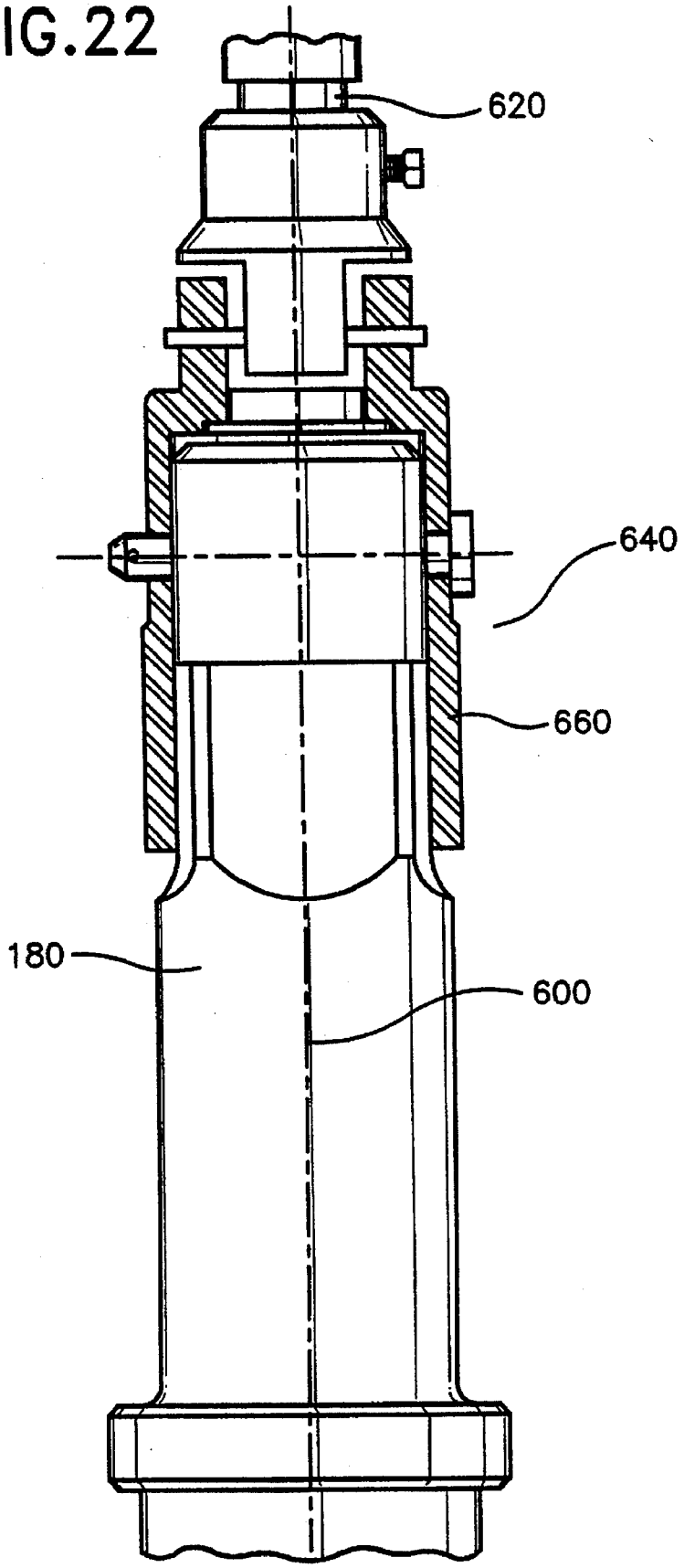

The coupling 580 includes an output housing 640. Referring particularly to FIGS. 15 and 16, the output housing 640 includes a hollow end portion 660 into which the first end 360 is fitted. In the preferred embodiment of the invention, the hollow end portion 660 is configured like the impeller shown in FIG. 21. That is, the end portion 660 includes four concave sidewall portions 680 and four rounded corners 700 that connect the sidewall portions 680. Although output housing 640 is shown connected to the motor with a quick disconnect assembly of FIGS. 10–14, the more economical pinned arrangement of FIG. 22 can be utilized.

Referring again to FIGS. 1 and 2, in addition to cement attachment of the impeller to the drive shaft 30, the impeller is secured to the drive shaft via graphite dowel pins 80. The impeller is further secured to the shaft 30 via a back-up sleeve 82 which acts as reinforcement to the attachment joint and as a locator for the impeller. Both of these embodiments are covered in U.S. Pat. No. 5,025,198, herein incorporated by reference.

A further bearing ring 84, comprised of silicon carbide or other thermally resistant bearing material, encircles the upper most portion of the back-up sleeve 82. This bearing ring 84 is opposed by another bearing ring 86 on baffle plate 50. The back-up sleeve 82 is generally affixed to the shaft 30 and prevented from upward movement via a collar ring 88 on the shaft 30.

Figure 3A:
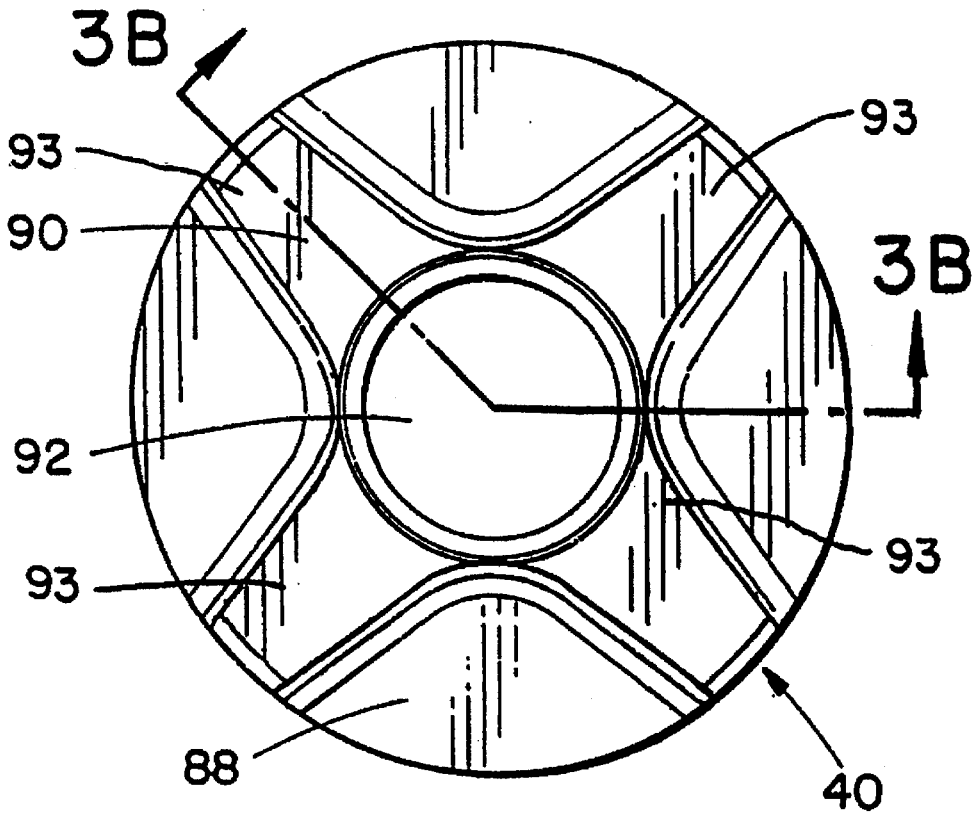
FIG. 3A is a top view of the impeller of FIGS. 1 and 2 and FIG. 3B is a cross-sectional view taken along line 3B.
Figure 3B:
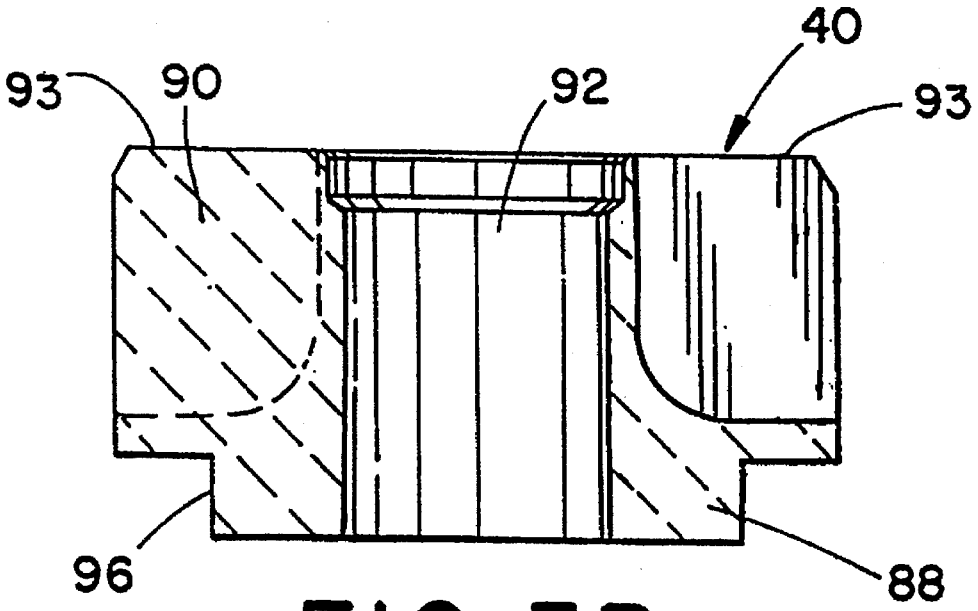

Referring now to FIGS. 3A and 3B, the impeller 40 is shown as a four-vaned circular based impeller. The impeller consists of a circular base 88 with four vanes 90 extending from a hub 92 constructed to mate with shaft 30, perpendicular to the face 88. Vane, as used herein, generally means a flat or curved object rotated about an axis that causes or redirects fluid flow. In addition as used herein, vane means an independent surface imparting work on the molten metal. The impeller has a recessed based portion 96 for attachment of silicon carbide bearing ring 42. Typically, the vanes are tapered with the thickest section beginning at the center most portion of the impeller adjacent the hub/shaft. The tapering and the thickness of the vanes influence the wear from inclusions and/or sediment in the molten metal and molten metal fluid volume. Particularly, the thickness and the dimensions facilitate the durability of the vanes under stress.

An important attribute of the impeller design is a larger outlet area "X-X" than inlet area "Y-Y". The inlet "Y-Y" area is generally adjacent an upper surface 93 of the impeller blades 90 and is generally adjacent the hub 92 where the lowest pressure occurs. In a bottom feed molten metal pump, the upper surface 93 would face the bottom of the pump and the hub is in the non-vaned surface (best seen in FIG. 5). By maintaining a large exit area and smaller inlet area, all particles ingested into the impeller can be expelled.

Figure 4:
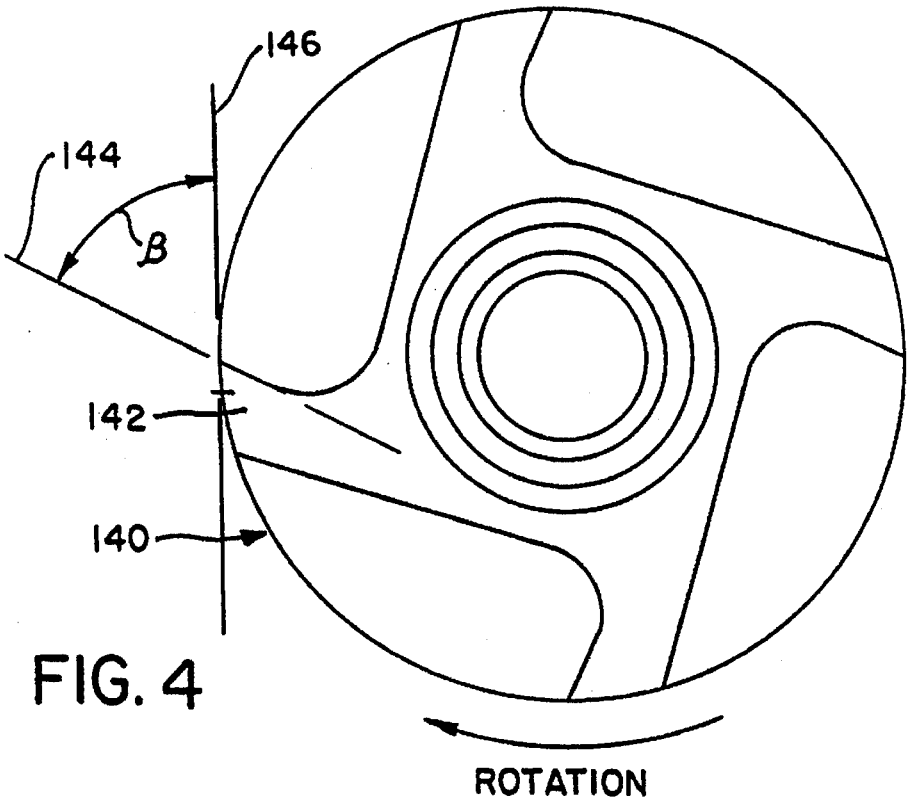
FIG. 4 is a top view of an alternative impeller embodiment showing forward curved vanes.

In addition to the problems prevented by particles in the molten metal, cavitation is believed to be another cause of degradation to the vanes of the impeller and a contributor to reduced effectiveness. In this regard, the forward curve embodiment of FIG. 4 has been found to produce at least a 7% higher flow rate per revolutions per minute (rpm) and can run at least a 7% higher rpm with reduced cavitation, extending the life of the impeller. The forward curve used herein can be defined generally as an aspect of the vane wherein the curve of the terminal portion on the leading edge of the vane as shown by line 144 creates an acute angle β relative to a tangent 146 on the perimeter of the impeller at its intersection with the vane. Forward is defined relative to the direction of rotation of the impeller.

This result with a forward curve vane is surprising because cavitation is generally believed to be more easily reduced with a backward curve or radial blade design. However, Applicants have found that in a molten metal environment, a forward curved blade is preferable.

Without being bound by theory, it is believed that molten metal pumps, due to the density of molten metal, have different requirements. Particularly, in a water environment, given diameter impellers are designed to increase efficiency by maximizing speed of rotation. In contrast, in a molten metal pump environment, it is desirable to achieve a maximum flow with a minimum speed of impeller rotation. In this case, a forward curved impeller is believed to be beneficial.

This is supported by the test data of Table I. In each of Examples 1–6 a L-25 molten metal circulation pump was used in a water bath.

Example 1 is a water test showing effectiveness of an impeller design as shown in FIG. 3A. Example 2 is a water test showing effectiveness of an impeller which is the mirror image of the design shown in FIG. 5, installed in a top feed pump. Example 3 demonstrates the effectiveness of the impeller of FIG. 4.

TABLE I

| | Flow in Gallons per Minute (GPM) | | |
|---|---|---|---|
| RPM | 1 | 2 | 3 |
| 300 | 165 | 127.5 | 180 |
| 600 | 300 | 247.5 | 337.5 |
| 900 | 450 | 375 | 495 |

Figure 8:
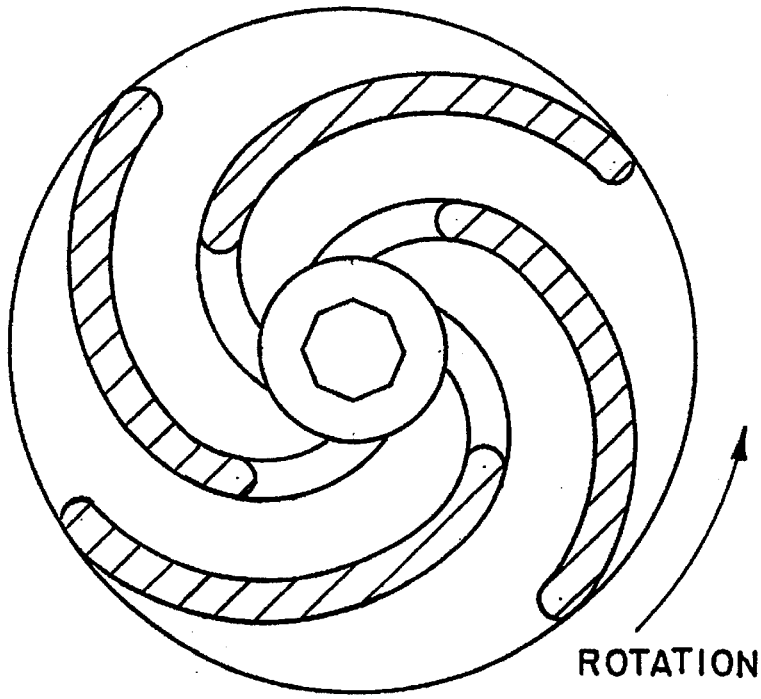
FIG. 8 (PRIOR ART)
FIG. 8 is a top view of a prior art impeller similar to FIG. 7, however, with a larger inlet area than outlet area.

As seen in Table II, the design of the current invention is significantly superior to that of the prior art design shown in FIG. 8. More particularly, the impeller design of FIG. 5 for a top feed pump was evaluated relative to a prior art impeller design.

Figure 5:
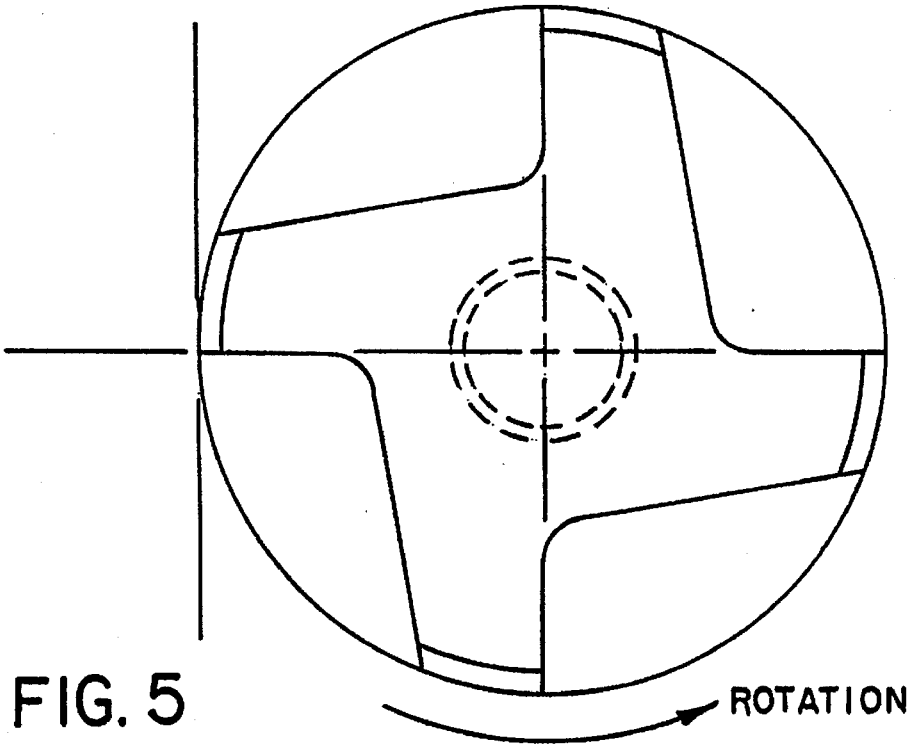
FIG. 5 is a top view of an alternative impeller embodiment for a bottom feed pump.
Figure 7:
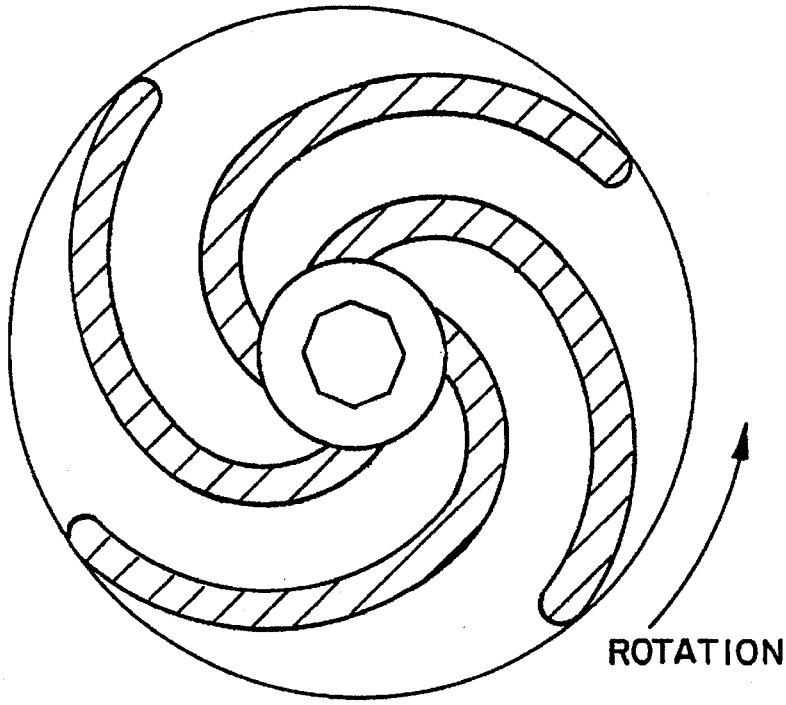
FIG. 7 is a top view of a alternative impeller embodiment having curved vanes.

Example 4 is a water test of the impeller shown in FIG. 7. Example 5 is a water test of an alternative version of the prior art design impeller with relieved vanes adjacent the hub as shown in FIG. 8. Example 6 demonstrates an impeller design of the current invention (FIG. 5).

TABLE II

| | Flow in GPM | | |
|---|---|---|---|
| RPM | 4 | 5 | 6 |
| 200 | 67.5 | 75 | 112.5 |
| 400 | 142.5 | 135 | 232.5 |
| 600 | 210 | 202.5 | 337.5 |
| 800 | 270 | 277.5 | 450 |
| 1000 | 330 | 345 | 577.5 |

Figure 6:
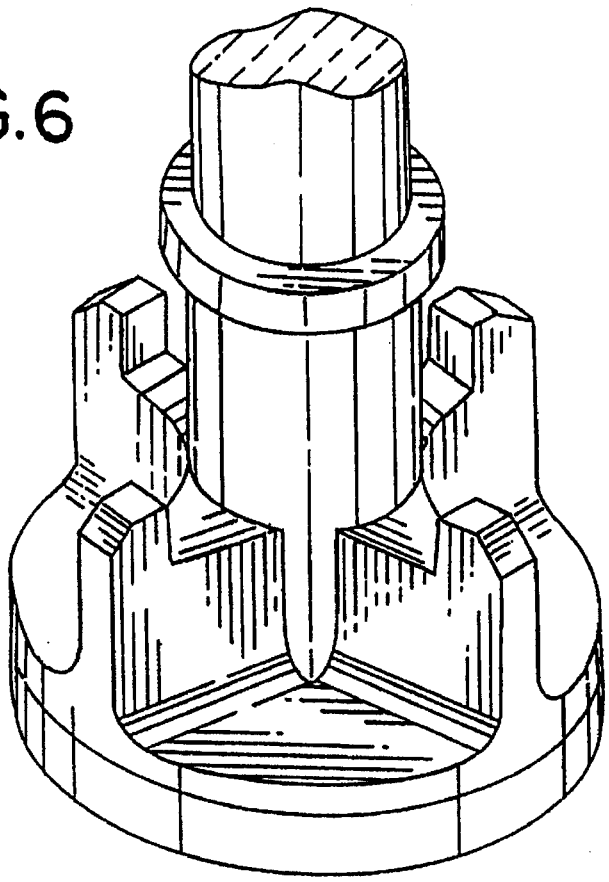
FIG. 6 is an elevational view of an alternative impeller embodiment having four relieved vanes.

FIG. 6 demonstrates an alternative impeller design. Relief of a portion of the vanes near the shaft/hub provides increased fluid access, however, mechanical strength is somewhat reduced.

Figure 9:
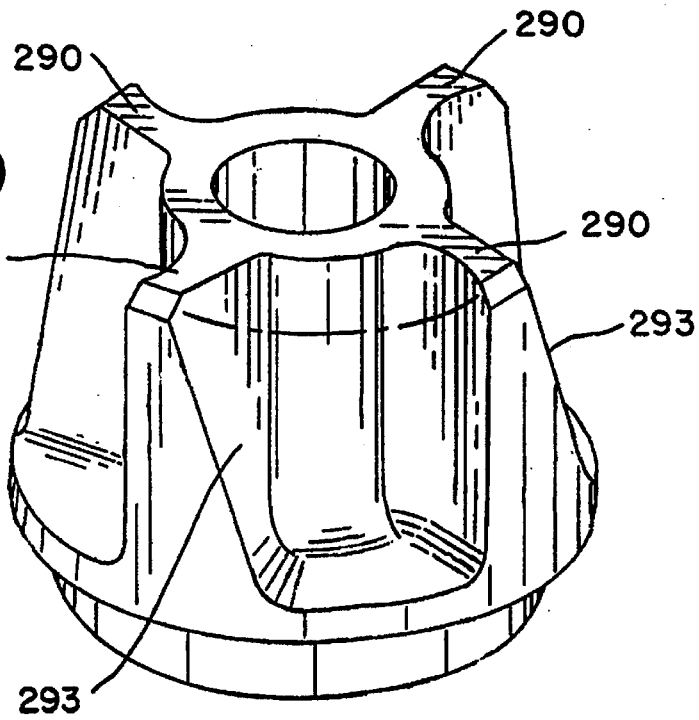
FIG. 9 is a perspective view of an alternative impeller embodiment having forward curved vanes.

FIG. 9 illustrates a particularly preferred impeller embodiment having four vanes 290 extending from a hub 292. In this embodiment each vane 290 is forward curved in a manner similar to that shown in FIG. 4. In addition, each vane includes a slanted back wall 293.

It will be appreciated from the foregoing descriptions that the molten metal pump according to the invention, possesses the advantages of high efficiency and durability. Particularly, the impeller in relationship to the described shaft and motor mechanism is effective in the transfer of molten metal with reduced clogging and/or catastrophic failure.

Thus it is apparent that there has been provided in accordance with the invention, a molten metal pump that fully satisfies the objects, aims, advantages set forth above. While the invention has been described in conjunction with specific embodiments thereof, it is evident that many alternatives, modifications, and variations will be apparent to those skilled in the art in light of the foregoing description.

Accordingly, it is intended to embrace all such alternatives, modifications, and variations as fall within the spirit and broad scope of the appended claims.

Having thus described the invention, it is claimed:

1. A molten metal pump comprising:

a shaft having first and second ends, at least one end being multi-sided in cross-section and including a plurality of rounded side portions having a relatively large radius and rounded corners connecting the side portions, the corners having a relatively small radius;

a means for rotating said shaft in communication with said first end of said shaft;

an impeller in communication with said second end of said shaft; and, a volute housing said impeller, wherein said volute has a first opening through which molten metal can be drawn and a second opening through which molten metal can be discharged.

2. The pump of claim 1 wherein said shaft end is comprised of four side portions and four corners are provided, the side portions being at right angles to each other.

3. The pump of claim 1 wherein the end of said shaft includes a plurality of rounded said portions having a relatively large radius and rounded corners connecting the said portions, the corners having a relatively small radius.

4. The pump of claim 1 wherein said shaft is comprised of graphite.

5. An impeller shaft assembly, comprising:

an elongate shaft having first and second ends, the first end adapted to be connected to a coupling which in turn is adapted to be connected to a drive motor and the second end adapted to be connected to an impeller; and, the first end of the shaft being multi-sided in cross-section and including a plurality of rounded side portions having a relatively large radius and rounded corners connecting the side portions, the corners having a relatively small radius.

6. The assembly of claim 5, wherein four side portions and four corners are provided, the side portions being disposed generally at right angles to each other.

7. The assembly of claim 5, wherein the first end of the shaft includes a plurality of rounded side portions having a relatively large radius and rounded corners connecting the side portions, the corners having a relatively small radius.

8. The assembly of claim 5, wherein the second end of the shaft includes four side portions and four corners, the side portions being disposed generally at right angles to each other.

9. The assembly of claim 5, wherein the first and second ends of the shaft are configured substantially identically.

10. The shaft of claim 5 being comprised of graphite.

* * * * *